US005476040A

United States Patent [19]

Kleist

[11] Patent Number: 5,476,040

[45] Date of Patent: Dec. 19, 1995

[54] PAD PRINTING MACHINE WITH IMPROVED HOLD DOWNS

[75] Inventor: Egon Kleist, Hanover Park, Ill.

[73] Assignee: Trans Tech America, Inc., Carol Stream, Ill.

[21] Appl. No.: 449,817

[22] Filed: May 24, 1995

[51] Int. Cl.[6] ..... B41F 1/00

[52] U.S. Cl. ..... 101/163; 101/167; 101/327; 101/492; 101/41

[58] Field of Search ..... 101/163, 167, 101/327, 379, 368, 35, 41, 44, 492, 170

[56] References Cited

U.S. PATENT DOCUMENTS

| | | | |
|---|---|---|---|
| 4,060,031 | 11/1977 | Philipp | 101/163 |
| 4,314,504 | 2/1982 | Combeau | 101/41 |
| 4,557,195 | 12/1985 | Phlipp | 101/163 |
| 4,615,266 | 10/1986 | DeRoche et al. | 101/163 |
| 4,709,632 | 12/1987 | Samuels et al. | 101/163 |
| 4,779,531 | 10/1988 | Ueno et al. | 101/169 |
| 4,905,594 | 3/1990 | Phlipp | 101/163 |
| 5,237,922 | 8/1993 | Ho | 101/333 |
| 5,272,972 | 12/1993 | Tobita | 101/163 |
| 5,272,973 | 12/1993 | Chojnacki | 101/163 |
| 5,392,706 | 2/1995 | Drew, II et al. | 101/163 |

*Primary Examiner*—Eugene H. Eickholt
*Attorney, Agent, or Firm*—Leydig, Voit & Mayer, Ltd.

[57] ABSTRACT

A pad printing machine is disclosed in which the downward pressure forces are transferred to a thrust collar on the ink cup by application through a divided bearing which applies the hold-down forces at points that are spaced forward and rearward of the transverse pivot axis of the ink cup, and only at such spaced points, to resist rocking moments such as may arise from the reciprocating movements of the cliche. Further, the thrust collar is a combination of a very rigid pressure ring and a hard but slightly resilient plastic pressure distribution ring which is accurately machined after subassembly with the rigid ring to assure full mating engagement with the upper surface of the annular flange around the entire circumference of the ink cup, to assure uniform pressure of the entire knife edge on the cliche. In a preferred embodiment, the ink cup also is formed of a hard plastic.

29 Claims, 3 Drawing Sheets

PAD PRINTING MACHINE WITH IMPROVED HOLD DOWNS

FIELD OF THE INVENTION

The present invention relates generally to pad printing machines, and more particularly, to improved hold down arrangements for ink cups in such printing machines.

BACKGROUND OF THE INVENTION

Pad printing machines comprise an ink cup which is supported in inverted fashion with a sealing end thereof on a cliche that is mounted in reciprocating fashion for transferring ink in a predetermined printing pattern to a printing pad. The ink cup includes an annular surface, which may be an integral part of the cup, or alternatively, a separate ring, that serves as a sliding seal between the ink cup and the cliche and as a doctor blade or "knife" for ensuring that only the engraved portions of the cliche carry ink to the printing pad pick-up site. U.S. Pat. Nos. 4,557,195 and 4,905,594 disclose examples of prior such machines and their disclosures are incorporated herein by this reference.

To ensure quality printing with pad printers, it is important that the annular doctor blade of the ink cup reliably scrape or wipe from the cliche plate all ink that is not within the engraving recesses. Consistently obtaining the clean wiping action has presented problems, particularly when the cliche plates become warped or there are anomalies in the ink cup hold down mechanism. To obtain and maintain a sealing and wiping action, it has been proposed in said U.S. Pat. No. 4,557,195 to provide highly accurate microfinished surfaces on the doctor element and on the cliche and to allow slight swiveling movement of the ink container relative to the contact surface of the cliche. Downward force was applied to a shoulder around the ink container near its lower end by a compression spring for the stated purpose of generating a contact force approximately uniformly distributed over the end face.

The U.S. Pat. No. 4,905,594 proposed a different approach of allowing the doctor knife portion to move relative to the ink cup for adjustment purposes, with few critical dimensions, by providing a flexible connection of the doctor ring to the ink cup, together with a hold down mechanism which applied pressure at only a few predetermined points about the periphery of the ink cup. A commercial machine design of the assignee of said U.S. Pat. No. 4,905,594 utilizes a doctor knife ring made separately from the cup and mounted in the lower end of the cup, with a relatively soft plastic insert between the knife ring and the cup to allow relative adjustment movement between the knife and the cup. A hold-down pressure ring is mounted on pivot pins which extend horizontally transverse to the axis of movement of the cliche and provides three-point force transfer to the cup flange near the knife ring.

While such prior arrangements have met with some success, they require modification of the cup design and its mechanical function. Also, they can result in uneven application of contact pressures to various portions of the knife ring. Further, they permit fore-and-aft rocking tendencies of the knife ring which can vary the contact pressure with the engaged cliche as the cliche is reciprocated rapidly, which can result in undesirable variations of the scraping effect of the knife blade on the cliche.

OBJECTS AND SUMMARY OF THE INVENTION

It is an object of this invention to provide improved pad printing machines.

It is a more specific object to provide improved pad printing machines with hold-downs which overcome the aforementioned problems.

It is a further object of the present invention to provide pad printing machines with an ink cup and hold down design which achieves improved ink control even in cases of extreme cliche plate warpage.

Another object is to provide pad printing machines as characterized above which do not require a flexible connection between the doctor blade and the ink cup, nor the cup designs and costs associated with such designs and their manufacture.

It is another object to provide pad printing machines with improved hold-downs which resist rocking movements between the cliche and the cup, such as by resisting rocking moments that arise from the relative reciprocating interactions between those components.

It is a further object of this invention to provide such machines with hold-downs which assure maintenance of uniform contact pressure between the doctor knife and the cliche throughout the circumferential length of the knife for uniform clean wiping of the cliche during high speed operations and regardless of variations in the nominally planar surface contour of the cliche.

A pad printing machine is provided with an improved hold-down arrangement which resists the deleterious effects of rocking moments on the cup holder and insures uniform pressure of the entire doctor knife surface with the top of the cliche regardless of rocking tendencies of the cup during operation and regardless of variations in the planarity of the surface of the cliche. The downward pressure forces are transferred to a thrust collar by application approximately equally at points that are spaced forward and rearward of the transverse pivot axis of the ink cup, and only at such spaced points, to resist rocking moments such as may arise from the reciprocating movements of the cliche. The thrust collar is a combination of a very rigid pressure ring and a hard but slightly resilient plastic pressure distribution force-transfer ring which is accurately machined, to tolerances on the order of 0.02–0.05 mm and 0°15', after subassembly with the rigid ring, to assure application of the downward forces to the mating upper surface of the annular flange uniformly around the circumference of the ink cup. This uniform force is operative on the entire length of the knife, through the intervening portion of the cup and with attendant floating adjustments of the cup to obtain uniform pressure of the entire knife edge on the cliche.

Figure 1:
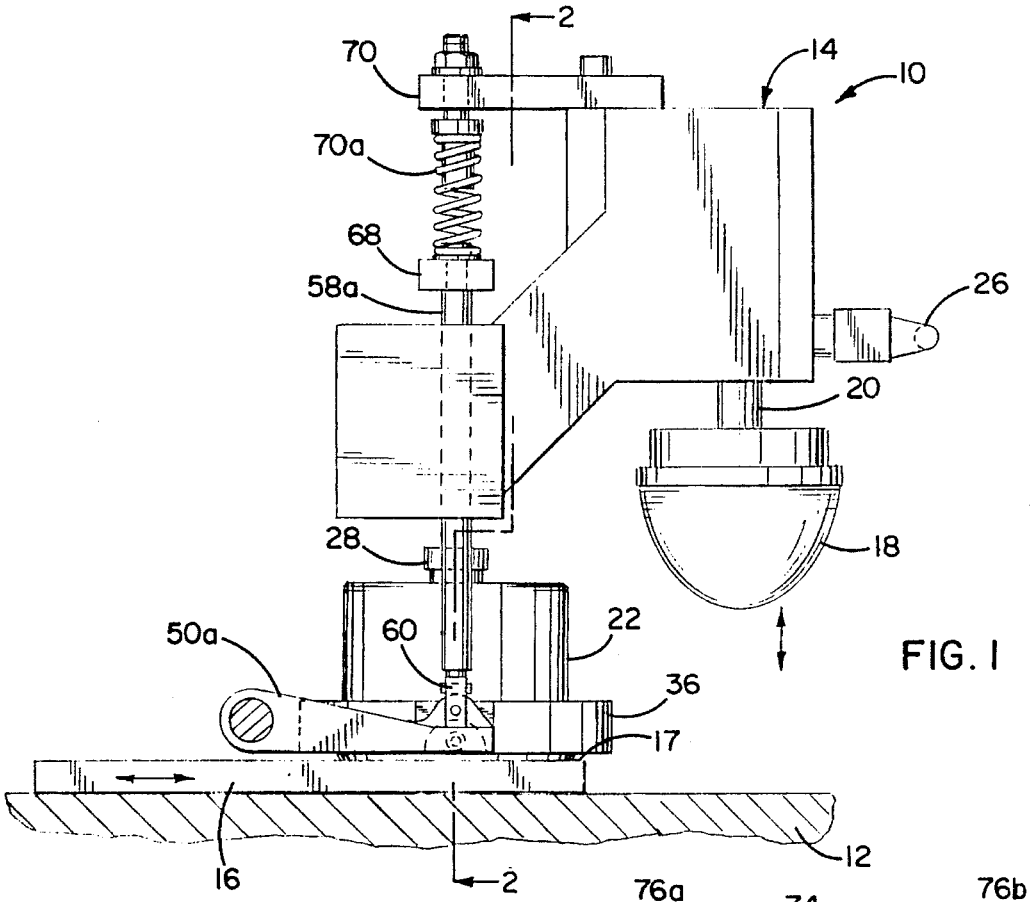
FIG. 1 is a side view of the printer section of a pad printing machine embodying teachings of this invention.
Figure 2:
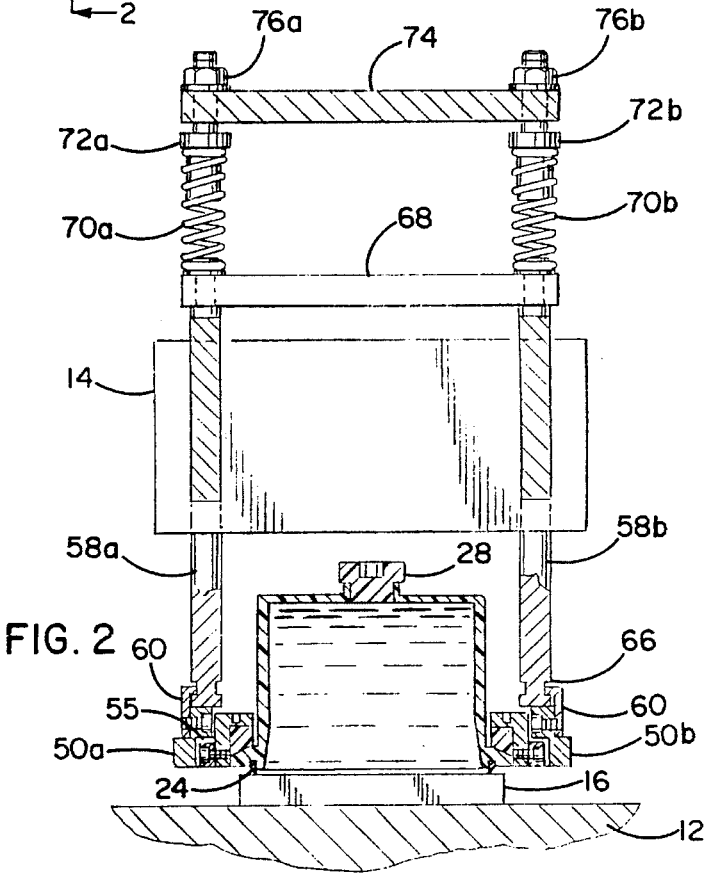
FIG. 2 is a vertical view, partially in section, taken generally along the broken line 2—2 of FIG. 1.

While the invention is susceptible to various modifications and alternative constructions, a preferred embodiment has been shown in the drawings and will be described in detail. It will be understood, however, that there is no intention to limit the invention to the specific embodiment, but on the contrary the intention is to cover all modifications, alternative constructions and equivalents falling within the spirit and scope of the invention.

DESCRIPTION OF THE PREFERRED EMBODIMENT

Figure 3:
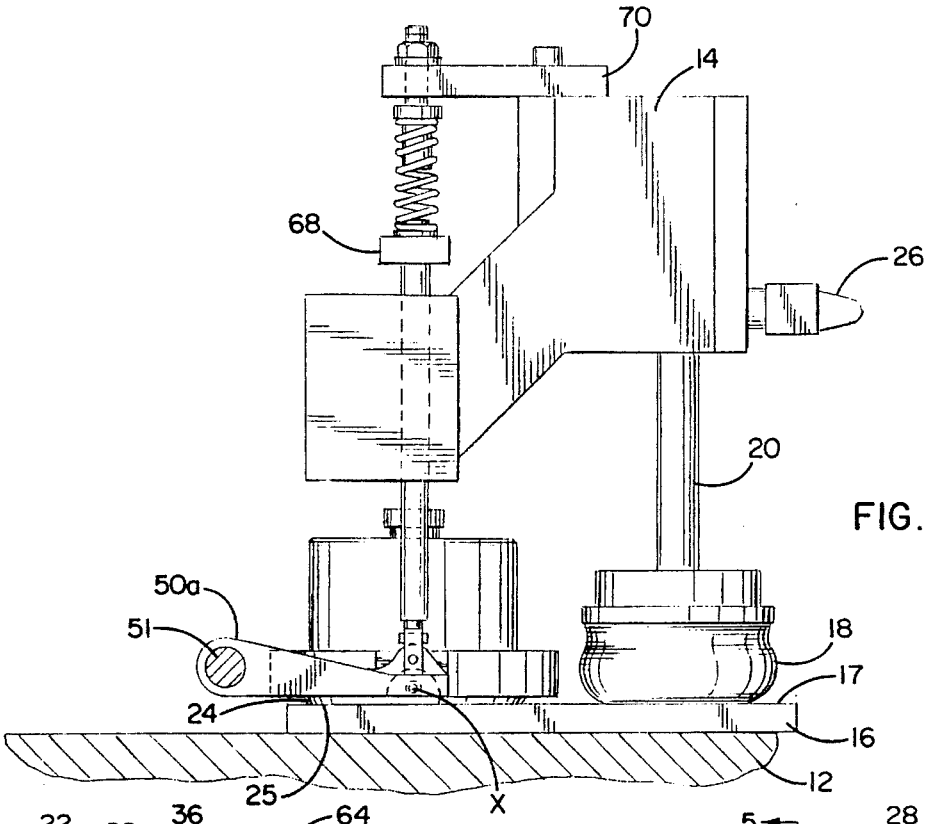
FIG. 3 is a view of the apparatus of FIG. 1 with the cliche and the printing pad advanced to their impression transferring positions.

The drawings illustrate the ink holding and transfer components of a pad type printing machine 10. The machine includes a support frame of which the illustrated portions include a base 12 and an upper frame portion 14 both of which are components of an appropriate frame structure for such machines, as is known in this art. A flat gravure plate 16 is suitably mounted on the plate bed for reciprocation between a retracted inking position as in FIG. 1 and an extended transfer position as seen in FIG. 3. This plate, also commonly known as a cliche, may be of any suitable material, typically being metal, plastic or a combination thereof and normally being photo engraved on its upper surface 17 with the text, logo or other pattern which is to be printed by the operation of the machine 10. A transfer pad 18 of appropriate configuration is mounted on a support rod 20 for suitable vertical reciprocating motion. With the cliche 16 extended, the pad 18 is pressed against the engraved area of the cliche as in FIG. 3 to receive the ink pattern therefrom and then is retracted upward. While the cliche subsequently is retracted as in FIG. 1 for re-inking, the pad 18 is advanced against a recipient object to transfer the ink pattern thereto, in a known manner by any appropriate coordinated driving mechanism.

An ink cup 22 is mounted over the cliche to serve as a supply reservoir for the printing ink. The cup has an open bottom for free access of the ink to the upper surface 17 of the cliche and has a doctor blade or "knife" ring 24 around its open lower end. This blade 24 must be maintained in intimate contact with the adjacent surface 17 of the cliche 16 at all times to form a seal for retaining the ink supply in the cup 22 and to scrape the surface 17 clean of all ink thereon as the cliche is advanced from the loading position of FIG. 1 to the transfer position of FIG. 3, except only for the ink in the depressions engraved or otherwise formed in the upper surface to define the print pattern. The blade 24 may be part of the cup itself or a separate element suitably attached to the lower end of the cup. In any event, as the doctor blade presents a very narrow edge surface 25 against the cliche and is subject to continual rubbing action by the cliche as the cliche is reciprocated, the knife blade ring 24 is formed of hard material or provided with a hard lower edge portion, such as of metal or plastic. If using plastic, a self-lubricating material such as the IGUS® "IGLIDE T500" material available from igus, inc., Providence, R.I., presently is preferred.

It is very important that the contact edge surface 25 of the knife ring and the upper surface 17 of the cliche be accurately formed and maintained in suitable compressive engagement with one another throughout the length of the knife blade, i.e. throughout the circumference of the ring. Slight variations in either surface, on the order of a few microns, or even variations in the compressive force therebetween along different portions of the circumference of the ring, can cause leakage of the ink, or leave a film of ink in undesired areas of the exposed portions of the cliche (sometimes referred to as "fogging") and/or cause scratches or other undesirable wear patterns on the cliche which can adversely affect the useful life of the relative expensive cliches. Thus, it is highly desirable that intimate but uniform pressure contact be maintained between the ring and the surface of the cliche despite non-planarity of either surface, such as may occur due to minor errors of manufacture and/or as a result of warping during use.

An adjustment handle 26 is provided at the front of the apparatus to adjust the effective length of the support rod 20.

A removable filler plug 28 is provided in the upper end of the ink cup. The cup 22 also includes an annular flange 34, such as is typically provided adjacent the lower open end of such ink cups.

The illustrated hold down mechanism for maintaining the cup in position with its doctor blade 24 in desirable continuous engagement with the cliche 16 includes a thrust collar 36 which fits in superposed relationship over the flange 34. The collar 36 is pivotably mounted at diametrically opposite sides by a pair of interconnection mechanisms **40*a* and 40*b* for pivotal movement about an axis "X" which is parallel to the surface 17 and perpendicular to the reciprocating path of the cliche. The two mechanisms 40*a* and 40*b*** are of the same construction, being mirror images of one another. Hence only one will be described in detail.

Figure 6:
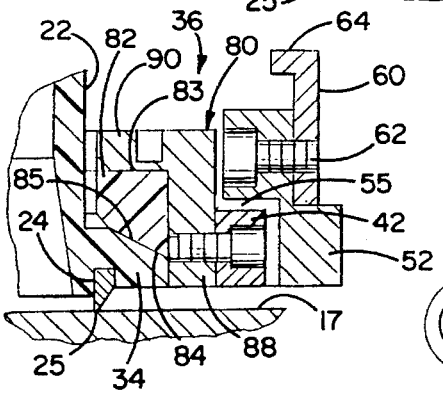
FIG. 6 is a further enlarged sectional view of the force transfer elements in the lower right hand portion of FIG. 5.
Figure 4:
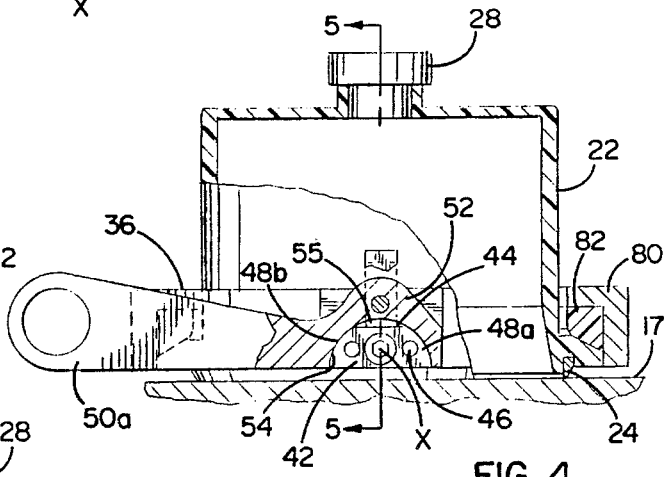
FIG. 4 is an enlarged side view of the ink cup and related hold down components of the apparatus in FIG. 1, with portions shown in section.
Figure 5:
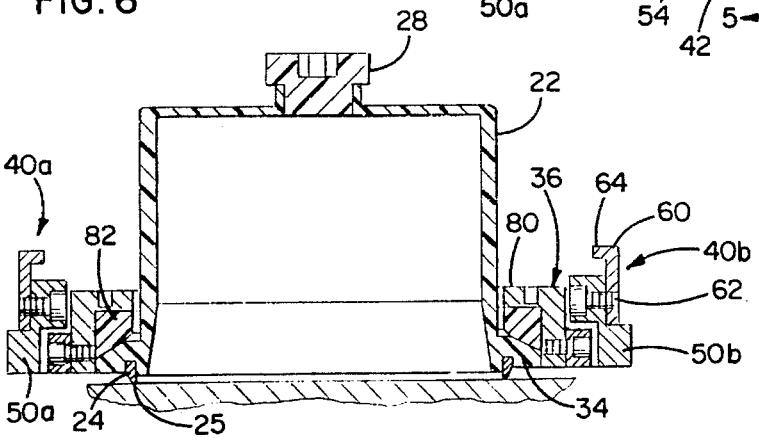
FIG. 5 is a sectional view taken generally along line 5—5 of FIG. 4.
Figure 7:
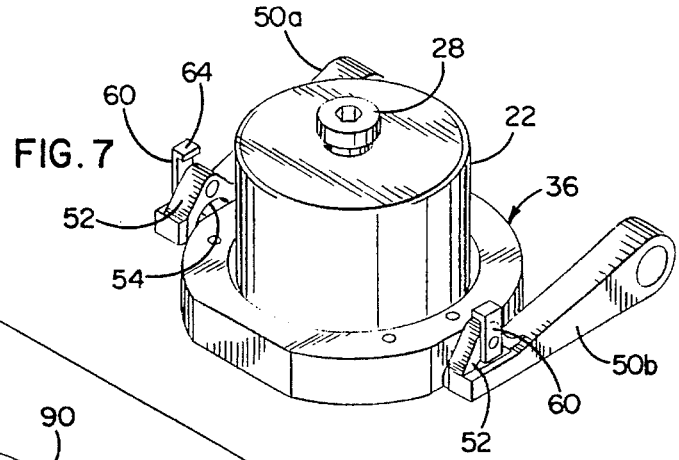
FIG. 7 is a perspective view of the ink cup and certain related hold down apparatus in FIG. 1.
Figure 8:
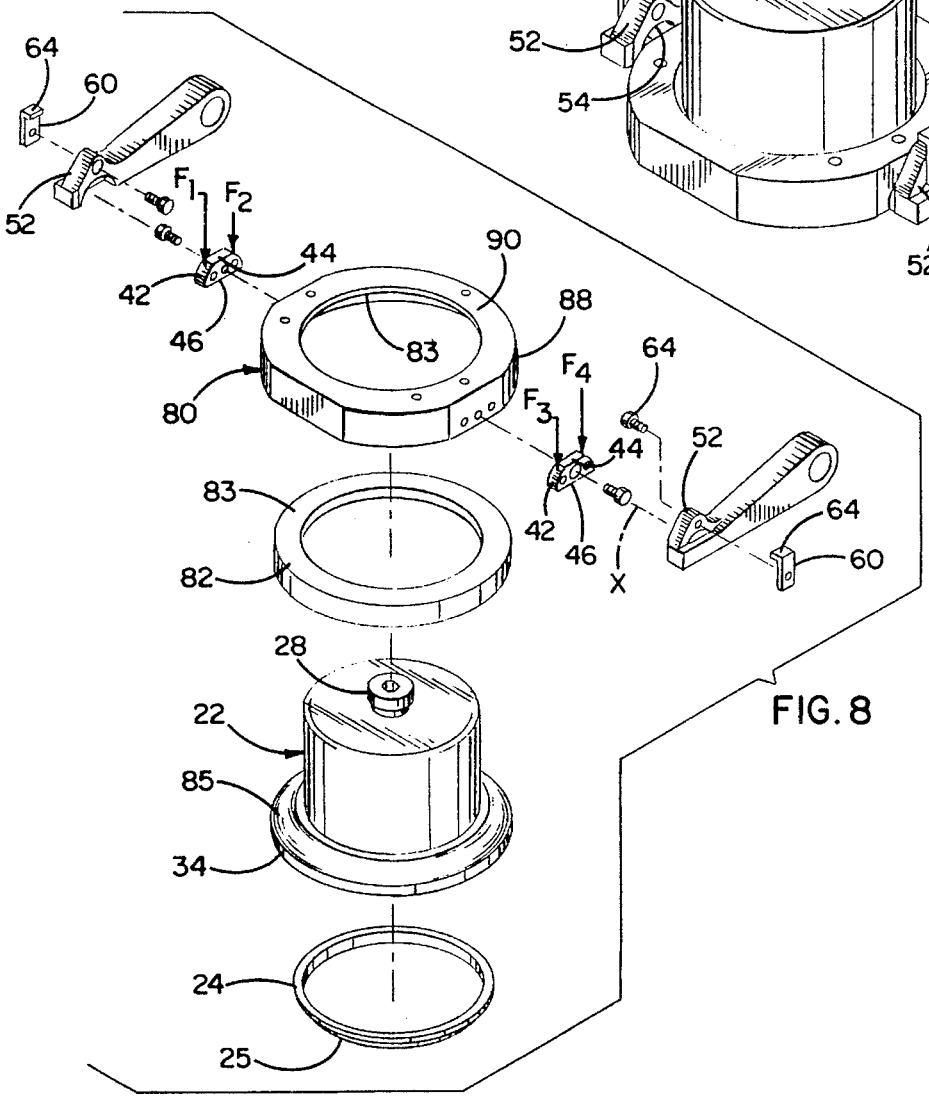
FIG. 8 is an exploded view of the apparatus of FIG. 7.

The bearing structure for applying external downward forces to the thrust collar 36 and thus to the cup 22 is of a design to assure that these forces are applied to the collar at points spaced forwardly and rearwardly of the transverse pivot axis X (see FIGS. 4 and 8) and not directly on the pivot axis, to provide a restraining or stiffening action which resists fore-and-aft tilting tendencies of the cup as the cliche reciprocates. Referring particularly to FIGS. 4–6, a truncated semicircular bearing element 42 is rigidly affixed to the respective side of the thrust collar 36, i.e. in a manner to prevent relative rotational movement between the collar 36 and the bearing 42. As perhaps best seen in FIG. 4, the bearing element 42 is of a semicircular arcuate configuration, truncated along an upper chordal edge 44 parallel to the lower diametral edge 46. The bearing element 42 forms two distinctively separate arcuate bearing surfaces **48*a* and 48*b* which are spaced from one another by the length of the chordal segment 44 which traverses the pivot axis X. Thus, the two bearing surfaces 48*a*, 48*b* are spaced fore-and-aft, respectively, from the diametral pivot mounting axis X of the ink cup 22**.

A pair of parallel clamping fingers **50*a* and 50*b* are pivotally mounted on the machine frame, as by being mounted on a transverse shaft 51 which is suitably supported on the machine frame. Each of the fingers 50*a*, 50*b* includes a pressure portion 52 which defines a circular arcuate bearing surface 54 that corresponds to and mates with the circular arcuate configuration defined by the respective pair of bearing surfaces 48*a*, 48*b*. However, there is no bearing contact in the chordal truncation area, whereby vertical force transfer to the thrust collar 36 directly over the transverse pivot axis is precluded; note the gap 55 between the central portions of the bearings as seen in FIGS. 4–6**.

Down-pressure forces are applied to the finger portions 52 by a pair of pressure rods **58*a*, 58*b* which are disposed in parallel, upright arrangement over the respective pressure finger portions. Each of the pressure rods is connected to the respective finger portion. For this purpose, a bracket 60 is affixed to the respective finger portion 52, as by a machine screw 62, and has a transverse lip 64 which engages an annular groove 66 in the lower end of the respective pressure rod 58***a*, 58*b*.

The pressure rods 58*a* and 58*b* are jointly urged downwardly for applying downward force to the thrust collar 36 in such a fashion that the downward forces applied thereby may be balanced between the two sides of the collar. Also, slight vertical relative movements are allowed between the two pressure rods and hence between the two sides of the collar 36 to allow tilting adjustment of the collar and hence of the cup 22 transversely of the center longitudinal horizontal axis which is generally parallel to the direction of reciprocation of the cliche and orthogonal to the aforementioned X axis. To this end the pressure rods 58*a* and 58*b* are mounted for vertical movement in the machine frame portion 14. A pressure plate 68 is mounted on the upper ends of these two rods 58*a*, 58*b*. A pair of compression springs 70*a*, 70*b* engage the upper ends of the respective rods 58*a*, 58*b* and have their upper ends confined by respective adjustable tension screw mechanisms 72*a*, 72*b* which are supported in an upper spring plate 74 that is affixed to the machine frame 14. It will be appreciated that the compressive force applied by each spring 70*a*, 70*b* can be adjusted, such as by threaded adjustment of the respective mounting nuts shown at 76*a*, 76*b*, to thereby vary the downward pressure force applied to the thrust collar 36 generally in vertical alignment with the opposite ends of its transverse diametral pivot axis, while allowing slight tilting motion of the cup about that axis sufficient to maintain planar contact between the doctor blade 28 and the cliche 16.

The pressure rods apply downward forces to the pressure portions 52 of the fingers 50*a* and 50*b* generally in axial alignment with the transverse pivot axis X of the cup. Also, the collar 36 and the supported cup 22 are free for pivotal adjustment together about this transverse axis due to the mating circular arcuate bearing surfaces between the bearing components 42 and 52. However, application of those forces to the thrust collar assembly directly on the transverse pivot axis is precluded as noted above. Rather, the downward force at each side of the cup is divided into two components with one of those components being applied vertically at a position forward of the pivot axis X, through bearing segment 48*a*, and the other being applied vertically and of approximately equal magnitude at a position aft of the pivot axis, through the respective bearing segment 48*b*; see e.g. the force illustrations at $F_1$, $F_2$, $F_3$ and $F_4$ in FIG. 8. This distribution of the points of application of down-forces to the thrust collar, and thus to the cup through the collar-cup interface described further below, provides a stiffening action which counteracts the tendency of the cup to rock or tilt fore-and-aft in a pitching motion and thereby counteracts any tendency to create undue pressures between the forward and/or rearward portions of the doctor blade 28 and the abutting surface of the cliche 16 as the cliche is reciprocated longitudinally beneath the cup.

The thrust collar 36 comprises a rigid upper pressure ring 80, to which the bearing components 42 are affixed, and a lower pressure distribution force-transfer ring 82. The upper pressure ring preferably is formed of metal, particularly steel, and is rigid to avoid any significant deformation or distortion under the forces applied during operation of the subject machine. The pressure distribution ring 82 is formed of a material which is relatively rigid and machinable to close tolerances but which also has slight compressive resilience (high durometer values), to provide substantially full surface abutting engagement with the cup flange substantially all around the cup. It also must be compatible with printing inks and have high chemical resistance. Examples include a hard machinable plastic or a light metal such as aluminum of high durometer and hence having slight but only slight compressive resilience. Such plastic may be an ultra high molecular weight (UHMW) plastic such as a linear high density polyethylene (PE), i.e., having a molecular weight greater than about 3,100,00 g/mol (ASTM) and/or an intrinsic viscosity greater than about 19.2 (ASTM D4020) with a durometer in the range of about 65 to about 68 Shore "D" by the ASTM D2240 test method, and a density of about 0.926 to 0.940 gm/cm$^3$. The UHMW PE described below presently is the preferred material for the pressure distribution ring.

The pressure distribution ring 82 is affixed within the upper pressure ring 80 with these two pressure rings having continuous annular abutting surfaces at the generally horizontal interface 83 therebetween. The lower annular surface 84 of the ring 82 is machined after assembly of the ring 82 into the rigid ring 80, to very accurately form the lower exposed surface 84 to a configuration for close mating engagement with the upper annular surface 85 of the cup flange 34. To facilitate such accurate conformation of these surfaces for such close mating engagement, the surface 85 of the cup flange 34 is formed by precision molding or preferably also by accurate machining of the same or a harder compatible material. These surfaces 84 and 85 each extend continuously around the circumference of the cup 22 and each is very accurately formed, e.g. to tolerances on the order of the 0.02–0.05 mm and 0°15', such that they are in mating contact around the entire circumference to effect essentially uniform force transfer of the hold-down forces from the hold-down superstructure to the flange of the cup closely adjacent the lower edge of the cup and virtually directly over the circular doctor blade 24.

By way of one example, for use with an ink cup 22 of 80 mm I.D., 87.6 mm O.D. and having a flange 34 of 110 mm O.D. with a surface 85 having an I.D. of 94.4 mm and extending at an angle of about 30° relative to a plane normal to the longitudinal (vertical) axis of the cup, a rigid pressure ring 80 was formed with an L-shaped cross section as illustrated in FIGS. 4–6 of 4140 prehardened steel. This rigid ring 80 had an O.D. of 125 mm, an axial dimension of about 20 mm, an outer circumferential axial leg 88 at least 6 mm in radial thickness with an I.D. of about 110 mm, and an annular radial leg 90 of about 5 mm thickness measured axially of the cup and extending about 9 mm radially inward from the inner wall of the outer leg 88 to an I.D. of about 92 mm. The pressure distribution ring 82 was formed of a linear high density polyethylene material, namely a UHMW PE having a molecular weight greater than 4,000,000 g/mol, an intrinsic viscosity greater than 24 (ASTM D4020), a density of 0.93–0.94 gm/cc and a durometer value of about 67 Shore "D" by the ASTM D2240 test method. One such plastic material found to provide satisfactory results is the ultra high molecular weight polyethylene product currently marketed under the trademark TIVAR 1000®, marble reprocessed premium, by the Poly-Hi Solidur Division of Menasha Corporation of Fort Wayne, Ind.

The pressure distribution ring 82, having radial dimensions to match the I.D. of the inner flange 90 and to be press fit with the outer flange 88 while seating fully on the inner surface of flange 90, was press-fit into the rigid pressure ring to form the thrust collar. The exposed axial end surface of the ring 82 then was machined, after assembly with the ring 80, at an angle of about 30° to a plane normal to the longitudinal axis of the outer ring 80, to provide a continuous truncated conical pressure surface 84 which was parallel to the upwardly exposed truncated conical surface 85 defined by the cup flange 34. The matching circumferential conformation and accuracy of each of these mating conical surfaces ensured essentially continuous contact therebetween around the entire circumference of the cup 22. In this example, the critical planar surface dimensional tolerances were on the order of 0.02 mm or 0.03 mm, and the tolerance for the pressure ring surface 84 was plus 0°0', minus 0°7', and the tolerance for the cup surface 85 was plus 0°7', minus 0°0'. The angle tolerance values assured that if there is any divergence of these conical surfaces, then abutment therebetween will occur first at the radially inward edge of their interface, thereby assuring maximum force transfer closest to the cup wall and thus closest to axial alignment with the subjacent doctor blade 24.

While the pressure distribution ring 82 is quite hard, the small degree of resilience which it affords assures substantially uniform force transfer around the entire circumferential interface 84/85 of the thrust ring and the cup flange regardless of minor variations within the machining accuracy of the two components. This assures essentially uniform transfer of force all around the cup to all portions of the doctor blade 24 and thus uniform contact pressure of the blade against the cliche throughout the circumference of the blade.

In the preferred embodiment, the cup 22 also is formed of a hard plastic, such as the UHMW PE product TIVAR 1000® to afford a complementary degree of compressive resilience at the interface 84/85. However, many of the benefits of this invention are realizable with ink cups formed of other materials, such as aluminum, steel or other metals, or other plastics, or of other designs, together with a thrust collar formed by a rigid pressure ring and a plastic insert force distribution ring which provides a continuous annular matching contact surface with a circumferential flange around substantially the entire circumference of the ink cup.

From the foregoing it can be seen that apparatus and related methods have been provided which accomplish the aforenoted objects of this invention.

It will be understood that other variations, modifications and the substitution of equivalent mechanisms can be affected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. A pad printing machine in which a cliche is reciprocative along a predetermined path, an ink container disposed over the position of such a cliche with a doctor blade on a lower portion thereof around an open end and which blade is pressed against such a reciprocative cliche to form a liquid seal and to scrape ink from said cliche as a printing portion of said cliche is extended from beneath said container along said predetermined path, and a hold-down mechanism for pressing the said doctor blade against such a cliche, said hold-down mechanism including a holder which engages; said lower portion of such an ink container and holds same in a predetermined position relative to said holder, said holder mounted in said hold-down mechanism for pivotal rocking adjustment movement of said holder and said lower portion engaged thereby about a transverse axis which is transverse to said predetermined path, said holder including portions disposed on each side of said transverse axis, and down-force transfer elements engaging said holder at positions spaced from said transverse axis on opposite sides of said axis and thereby resisting pivot rocking of said holder and ink container about said transverse axis while applying down-forces to press said doctor blade against said cliche.

2. The invention as in claim 1 wherein said holder includes an annular element for surrounding an ink container and applying down-force to such a container in multiple areas along the circumference of such container.

3. The invention as in claim 2 for use with such an ink container which has a radially extending flange around its circumference, said annular element being of a configuration to engage such flange of such an ink container along substantially the entire circumference of the container.

4. The invention as in claim 1 including a first bearing element on said holder in a fixed position relative to said holder, said hold-down mechanism including a second bearing element disposed in opposed mating relation to said first bearing element, each of said first and second mating bearing elements spanning said transverse axis, and said bearing elements being of configurations to permit compressive engagement between said first and second bearing elements only at points spaced on each side of said transverse axis.

5. The invention as in claim 4 wherein said second bearing element defines a circular arch bearing surface which spans said transverse axis, and said first bearing element defines segments of a bearing circle of the same radius as said circular bearing arch surface and separated from one another by portions of said first bearing element having peripheral outer surfaces of lesser radii than said bearing circle, said segments being disposed on opposite sides of said transverse axis and engaging said arch surface on the respective sides of said transverse axis, and said portions of lesser radii spanning said axis.

6. The invention as in claim 5 wherein said second bearing element is disposed with said circular arch bearing surface exposed downward and said first bearing element segments are disposed with said bearing segments exposed upward.

7. The invention as in claim 6 wherein said holder includes an annular element for surrounding an ink container and applying down-force to such a container in multiple areas along the circumference of such container.

8. A pad printing machine in which a cliche is reciprocative along a predetermined path, an ink container disposed over the position of such a cliche with a doctor blade on a lower portion thereof around an open end and which blade is pressed against such a reciprocative cliche to form a liquid seal and to scrape ink from said cliche as a printing portion of said cliche is extended from beneath said container, said container including a generally vertical side wall and a flange extending radially outward from said side wall and presenting an upwardly exposed flange surface around said container, and a hold-down mechanism for pressing the said doctor blade against such a cliche, said hold-down mechanism including an annular thrust collar disposed around said container over said flange and movable relative to said container, said thrust collar including a rigid ring which includes a thrust surface disposed over said flange, and a resilient force-transfer ring disposed between said thrust and flange surfaces and in substantially continuous uniform contact with each of said surfaces around said cup whereby downward pressure is applied on said cup flange by said force transfer ring substantially uniformly along the entire circumference of said cup when downward forces are applied to said rigid ring.

9. The invention as in claim 8 wherein said container is an ink cup, said side wall defines a cylindrical outer surface of said cup and said flange and each of said rings extends continuously around the periphery of said ink cup.

10. The invention as in claim 8 wherein said force transfer ring is formed of a hard slightly resilient plastic material having a transfer surface disposed downward for engaging said flange surface, and said transfer and flange surfaces are formed with the same configuration for such continuous uniform contact with one another around the circumference of said cup whereby forces are transferred from said thrust collar to said flange substantially uniformly along the entire circumference of said container.

11. The invention as in claim 10 wherein said transfer and flange surfaces are truncated conical surfaces which are inclined radially outwardly in a direction away from said thrust surface.

12. The invention as in claim 8 wherein said thrust collar includes said resilient force transfer ring.

13. The invention as in claim 12 wherein said force transfer ring is mounted in said rigid ring.

14. The invention as in claim 12 wherein said force transfer ring is mounted in said rigid ring by a press-fit.

15. A pad printing machine in which a cliche is reciprocative along a predetermined path and an ink container is disposed over the position of such a cliche with a doctor blade on a lower portion thereof around an open end and which blade is pressed against such a reciprocative cliche to form a liquid seal and to scrape ink from said cliche as a printing portion of said cliche is extended from beneath said container, said container including a generally vertical side wall and a flange extending radially outward from said side wall and presenting an upwardly exposed pressure surface around said container, said machine comprising a hold-down mechanism for so pressing said doctor blade against such a cliche, said hold-down mechanism including a thrust collar to receive such a container when the container is positioned in said machine and applying downward forces to at least a portion of said container, said thrust collar including a rigid ring which includes a thrust surface to be disposed over said flange of such a container and a resilient force-transfer ring mounted on said rigid ring in substantially continuous uniform contact with said thrust surface, said resilient ring having an exposed surface disposed to be in alignment with said pressure surface of such a container when positioned in said machine and being of a configuration corresponding substantially identically with the configuration of such pressure surface for application of downward pressure on said cup flange substantially uniformly along the entire circumference of said cup when downward forces are applied to said rigid ring.

16. The invention as in claim 15 wherein said resilient force-transfer ring is formed of machinable hard plastic and said exposed surface thereof is machined to said configuration.

17. The invention as in claim 16 wherein said exposed surface of said resilient force-transfer ring is machined to said configuration after assembly of said resilient ring with said rigid ring.

18. The invention as in claim 15 wherein said resilient force-transfer ring and said rigid ring are in press-fit engagement with one another.

19. The invention as in claim 15 wherein said upwardly exposed pressure surface of said flange and said exposed surface of said resilient ring each defines a truncated annular plane extending outward from its respective inner annular edge in parallel relation to one another within an accuracy of about 0°10'.

20. The invention as in claim 15 wherein said upwardly exposed pressure surface of said flange and said exposed surface of said resilient ring member define truncated conical surfaces.

21. The invention as in claim 20 wherein said upward surface and said contact surface conform to one another within an accuracy of about 0°7'.

22. The invention as in claim 15 wherein said transfer ring member is formed of an ultra high molecular weight machinable plastic.

23. The invention as in claim 15 wherein said rigid ring is mounted in said hold-down mechanism for pivotal rocking movement about an axis transverse to the reciprocative path of such a cliche in said machine.

24. The invention as in claim 23 wherein said hold-down mechanism includes elements for applying downward forces to said rigid ring at each side thereof adjacent said transverse axis.

25. The invention as in claim 24 wherein said elements for applying such downward forces on at least one side of said rigid ring are disposed at positions spaced from said transverse axis on opposite sides of said axis, thereby resisting pivotal rocking of said thrust collar about said transverse axis when downward forces are applied through said thrust collar to an ink container held thereby.

26. The invention as in claim 25 wherein said elements include a first bearing element affixed to said rigid ring in fixed relation thereto, and a second bearing element disposed in opposed mating relation to said first bearing element, each of said first and second bearing elements spanning said transverse axis, and said bearing elements being of configurations to permit compressive engagement therebetween only at points spaced on each side of said transverse axis.

27. The invention as in claim 26 wherein a set of said first and second bearing elements is so disposed at each side of said rigid ring for so applying such downward forces on opposite sides of said transverse axis at two opposite sides of said rigid ring.

28. The method of making a pad printing machine for applying hold down force to an inking container for pressing a doctor blade on said container against a cliche, including the steps of:

providing an inking container having at least a lower portion which supports a doctor blade and has an outwardly extending flange with an upwardly exposed surface of a predetermined configuration;

providing a rigid thrust ring member of a configuration to circumscribe said container and having a thrust surface which thereby will be disposed in superposed relation to said flange;

providing a machinable plastic force transfer ring member of a configuration to circumscribe said container between said flange and said thrust ring member;

affixing said transfer ring member to said thrust ring member to form a thrust collar;

thereafter machining the side of said transfer ring member which is to face said flange to form a contact surface thereon which is of the same configuration as said upwardly exposed surface of said flange;

positioning said thrust collar around said container with said contact surface in engagement with said exposed surface of said flange; and connecting force application elements to said rigid ring for applying force to said rigid ring in a direction toward said flange and thereby pressing said doctor blade on said container portion against said cliche.

29. The invention as in claim 28 wherein said rigid thrust ring is formed of steel and said machinable plastic force transfer ring is formed of an ultra high molecular weight plastic, and said affixing step comprises press-fitting said thrust ring and said transfer ring to one another.

* * * * *